US005199884A

United States Patent [19]

Kaufman et al.

[11] Patent Number: 5,199,884

[45] Date of Patent: Apr. 6, 1993

[54] BLIND MATING MINIATURE CONNECTOR

[75] Inventors: John W. Kaufman, Hershey; Donald J. Summers, Shiremanstown; Gregory R. Pratt, Etters, all of Pa.

[73] Assignee: AMP Incorporated, Harrisburg, Pa.

[21] Appl. No.: 801,561

[22] Filed: Dec. 2, 1991

[51] Int. Cl.[5] ..... H01R 9/09

[52] U.S. Cl. ..... 439/74; 439/80; 439/83

[58] Field of Search ..... 439/64, 74, 76, 78–81, 439/83, 660, 677, 680

[56] References Cited

U.S. PATENT DOCUMENTS

| | | | |
|---|---|---|---|
| 3,960,434 | 6/1976 | Soes | 339/176 |
| 4,479,686 | 10/1984 | Hoshino et al. | 339/17 |
| 4,616,893 | 10/1986 | Feldman | 439/83 |
| 4,678,121 | 7/1987 | Douty et al. | 439/83 |
| 4,734,060 | 3/1988 | Kawawada et al. | 439/660 |
| 4,869,677 | 9/1989 | Johnson et al. | 439/80 |
| 4,929,185 | 5/1990 | Wong et al. | 439/74 |
| 4,971,565 | 11/1990 | Fox | 439/74 |
| 5,030,107 | 7/1991 | Moon | 439/62 |
| 5,057,027 | 10/1991 | Yamada et al. | 439/83 |
| 5,104,324 | 4/1992 | Grabbe et al. | 439/83 |

FOREIGN PATENT DOCUMENTS 1268247 5/1968 Fed. Rep. of Germany .

424905 5/1967 Switzerland .

*Primary Examiner*—Paula A. Bradley

[57] ABSTRACT

A surface mounted connector (25) for interconnecting closely centered circuits such as those carried by circuit boards (12, 18) includes plug and receptacle housings (24, 90) which internest to interconnect edge mounted, thin stamped contacts (50, 116) on centers complementary those of said circuits which include a contact configuration producing a series of point contacts (70, 128) and solder wells (70, 130) to provide an improved solder joint between respective contacts and boards. The contacts extend outside the side walls of the housings (64, 164) to facilitate heat application for solder reflow and inspection of solder joints. The contacts further have barbs (66, 126) engaging the said housings to hold the contacts against displacement upon separation of the plug from the receptacle. Solder pads (76) are provided on each housing to mechanically hold the housing to a board, and the plug housings include bevels (34) and polarizing and aligning plastic posts (44) which fit in recesses (96) in the receptacle to facilitate blind mating with latching surfaces (48, 100) latching the plug and receptacle together. A method is taught which features a tapering of beam lengths of the plug contact (50) to reduce stress and optimize force and/or deflection characteristics.

8 Claims, 7 Drawing Sheets

BLIND MATING MINIATURE CONNECTOR

This invention relates to an electrical connector for blind mating to interconnect circuits such as printed circuit boards and a method for making contacts.

BACKGROUND OF THE INVENTION

In U.S. patent application Ser. No. 07/675,839 filed Mar. 7, 1991, and drawn to a surface mount connector, there is disclosed an extremely small electrical connector for interconnecting the circuits of circuit boards and the like. The connector there disclosed is capable of being rendered in an extremely miniature size, for example, for circuit traces having a pitch on the order of 0.5 mm and is adapted for surface mounting to boards which in turn carry components interconnected by the connector. Such connectors are particularly adapted for use with small electronic devices such as cameras, video cameras, and other relatively compact and densely packaged electronic products. At least in one application wherein component carrying boards are interconnected in parallel, the connector cannot be physically held as it is soldered to the surface of the board and plugged into a connector half soldered to the surface of an opposing board. The connection must be mated "blind," meaning that an installer cannot see the connector or hold the connector, but must rely upon the connector itself to facilitate mating, unmating being less of a problem. In addition to the difficulty of mating, the small, relatively delicate portions of the plastic and metal parts of a connector make damage from stubbing or mismating a definite problem.

It is, accordingly, an object of the present invention to provide an improvement for miniature electrical connectors which require blind mating. It is a further object to provide a miniature blind mating connector for interconnecting circuits of the type utilized on the surfaces of circuit boards, having extremely close center-to-center conductive trace spacings. It is a still further object to provide a surface mounted connector having features facilitating blind mating and alignment with circuit traces for surface mount soldering to circuit boards and the like.

It is a final object to provide a method of making spring contacts that minimizes stress and better controls contact force relative to deflection.

SUMMARY OF THE INVENTION

The present invention achieves the foregoing objectives through the provision of a connector having plug and receptacle housings wherein the plug housing fits within the receptacle housing and the contacts of the plug are recessed within the housing of the plug to be engaged by the contacts fitted in the housing of the receptacle, which is relieved to receive the plug. The connector of the invention includes contacts placed on close centers such as on the order of 0.5 mm (0.020 inches) to provide a high density interconnection. The housings of the connector include intermating surfaces defined by posts extending from the plug housing and recesses interiorly of the receptacle housing which polarize and align the connector halves for intermating. The plug housing is beveled to enter the receptacle housing in a precise way thereby preventing stubbing and mismating of the delicate contacts entering recesses of the housings during mating and, in spite of the necessity for blind mating.

The housings of the invention also include fasteners attached thereto and solderable to the printed circuit board surfaces to which the connector halves are attached to hold the connector halves to the boards and align the contacts therein with traces on the board. The contacts of the plug and receptacle halves are stamped of thin, spring grade metal to be set on edge in the housing recesses so as to be freestanding and capable of deflection within the housings, clear of the housing walls, in a sense transverse to the axis of engagement of plug and receptacle. This feature allows a normal deflection easing tolerances and assuring a substantial normal force engagement to assure a sufficient force to maintain a stable, low-resistance electrical interface between contacts when mated. The contacts of the receptacle include a straight post portion free standing for deflection. The contacts of the plug include a J-shaped spring portion and a method for making such contacts to have beams tapered in a novel way to maintain sufficient normal force, which assures stable electrical interface for a given deflection as well as minimizing stress. Each of the contacts, plug and receptacle, include projections which have barbs engaging the plastic of the housings to latch and lock the contacts to the housings there by minimizing displacement thereof. Each of the contacts further includes a foot extending outwardly of the housing and containing points projecting to define a solder well to both extend the surface area of a solder joint and allow the welling of a fillet broadening the solder contact surfaces with the circuit of a board to the contact. This feature facilitates an easy visual examination of the connector prior to soldering to make certain of alignment on the board surface, the ready application of heat to the contacts to effect a solder reflow, including heat sources of the infrared type, in addition to the usual types of heat application and, finally, a ready inspection of the solder fillet following reflow.

The contacts include relatively smooth edge surfaces that intermate with a relatively low force of engagement and disengagement, in a sliding movement. Latching of the connector halves together is accomplished by the provision of latching surfaces on the posts of the plug half with surfaces within the receptacle half when the halves are fully intermated.

IN THE DRAWINGS

DETAILED DESCRIPTION OF THE INVENTION

Figure 1:
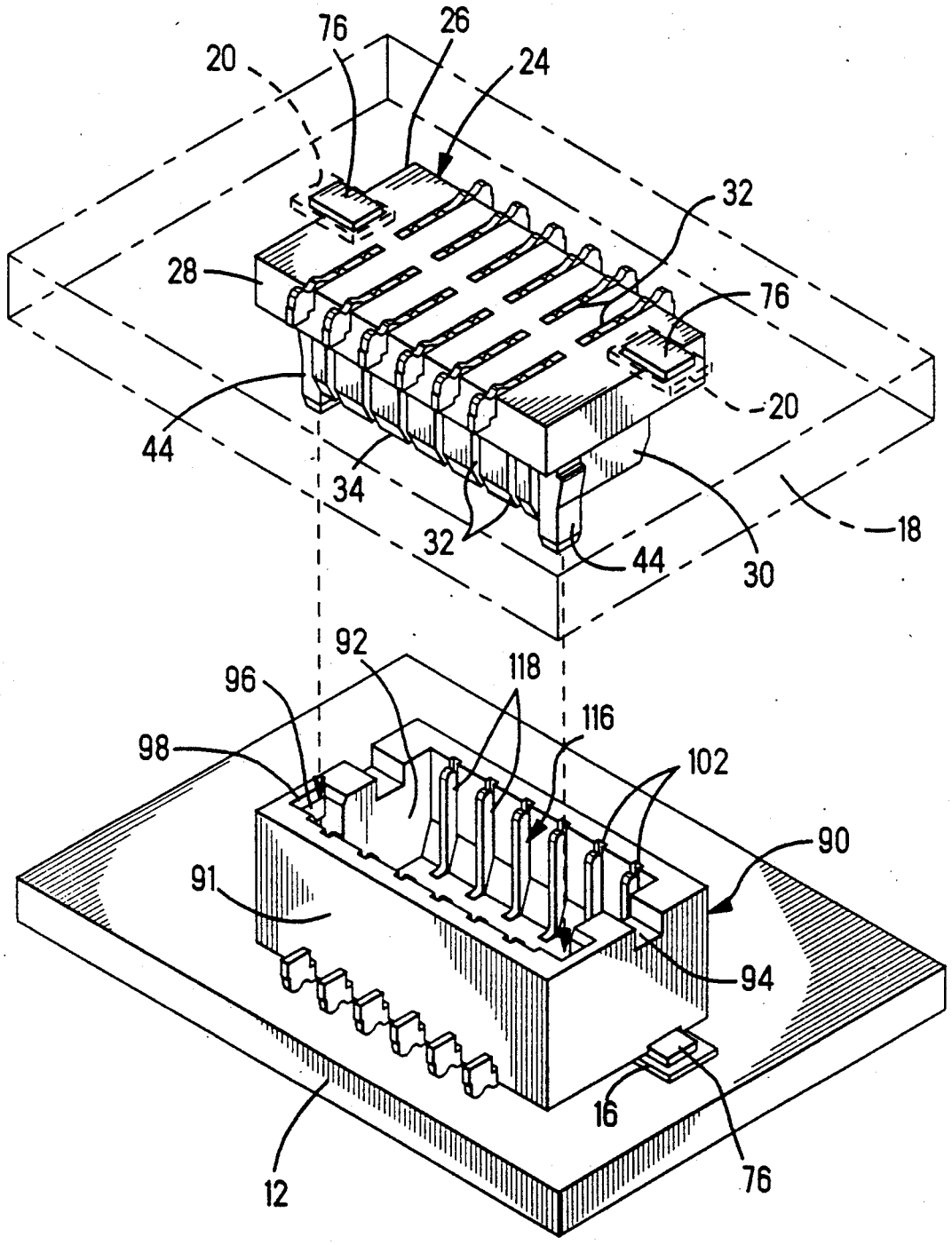
FIG. 1 is a perspective view of the connector of the invention, considerably enlarged, with the plug and receptacle halves joined to circuit boards shown partially in phantom, prior to intermating.
Figure 2:
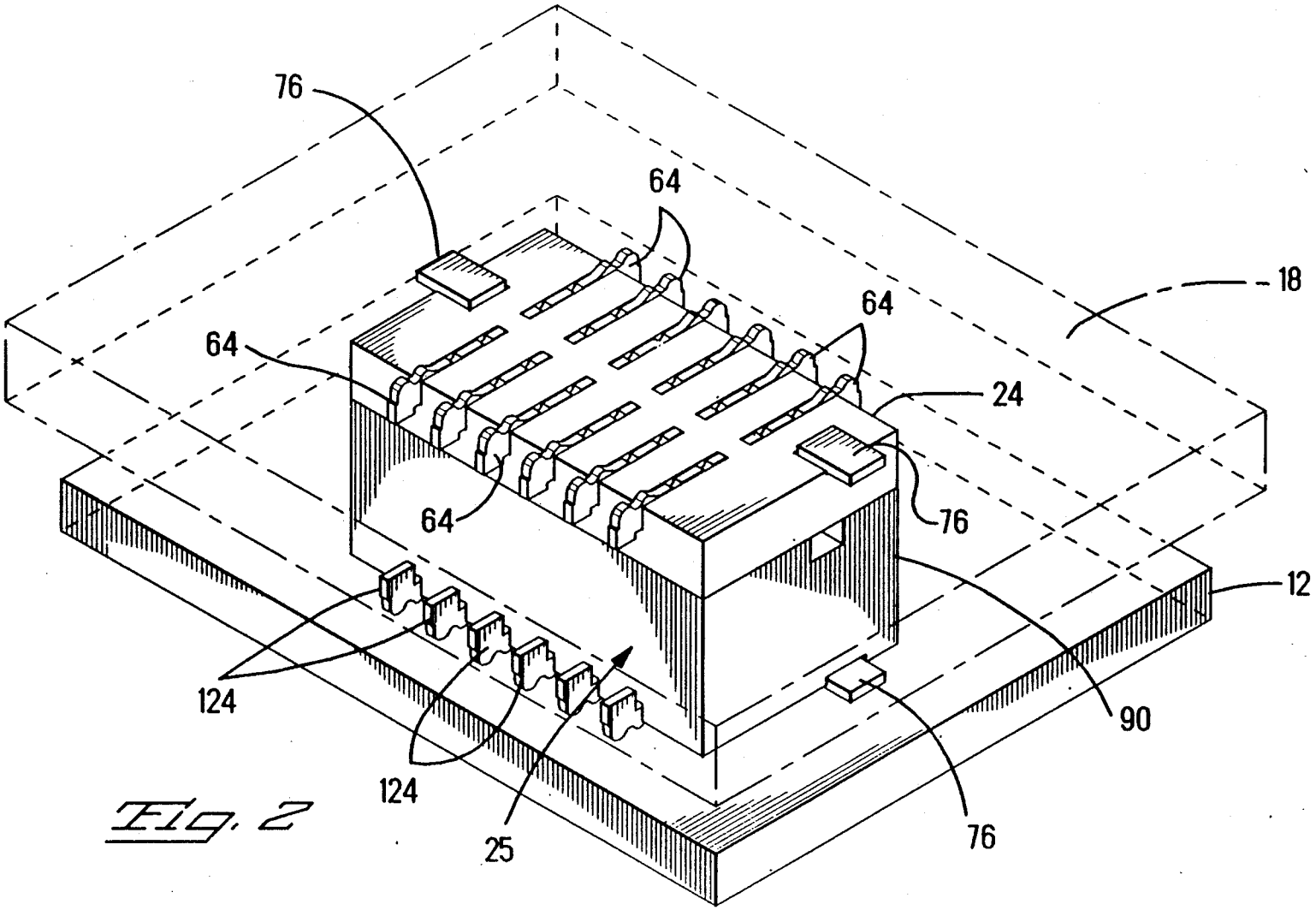
FIG. 2 is a perspective view, partially in phantom, showing the connector of FIG. 1, and the circuit boards thereof, intermated.

Referring now to FIG. 1, an assembly 10 includes a pair of circuit boards 12 and 18. These boards may be taken to be sections of much larger boards that carry components and interconnections to provide an electronic function for an electronic device. As can be appreciated from the views in FIG. 1 and FIG. 2, the connector 25, including the plug and receptacle halves 24 and 90, must be blind mated to interconnect, the position of the connectors in fact making it impossible for an operator to handle the connectors 25 themselves. To provide context, the stack heights or dimension between the inner surfaces of the boards 12 and 18 when the connector halves 24,90 are plugged together, as shown in FIG. 2, is on the order of 5 mm, or 0.197 inches for one size of connector, and 4 mm, or 0.157 inches for a smaller size connector. To intermate the connector halves, an installer must grasp one of the boards, such as board 18, shown in FIGS. 1 and 2, and push it toward the other board, such as board 12 until the connector halves engage and are intermated with the plug half 24 entering into the receptacle half 90.

Figure 3:
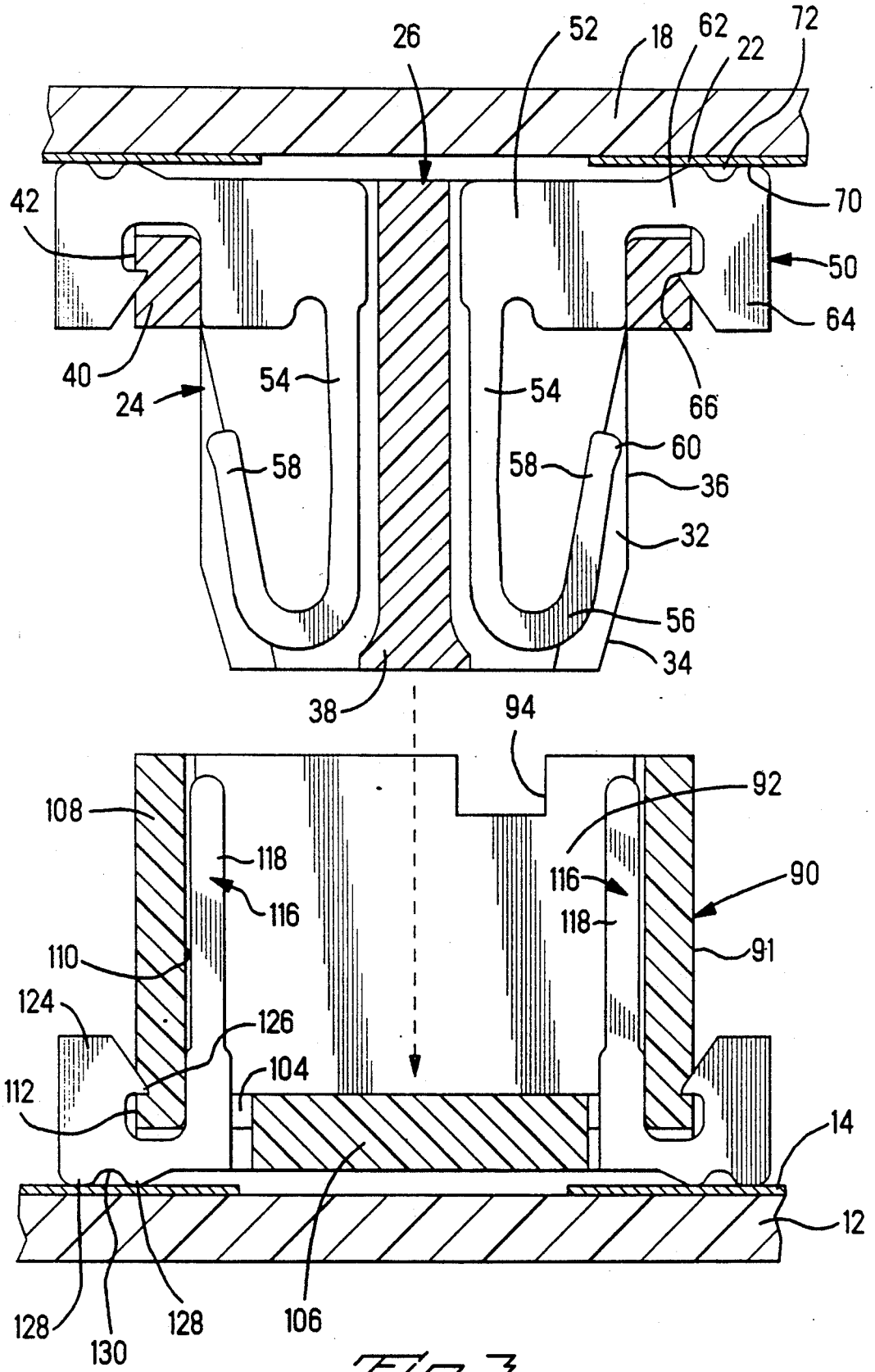
FIG. 3 is an elevation view, in partial section, showing the connector of the invention, aligned for, but just prior to, mating.
Figure 4:
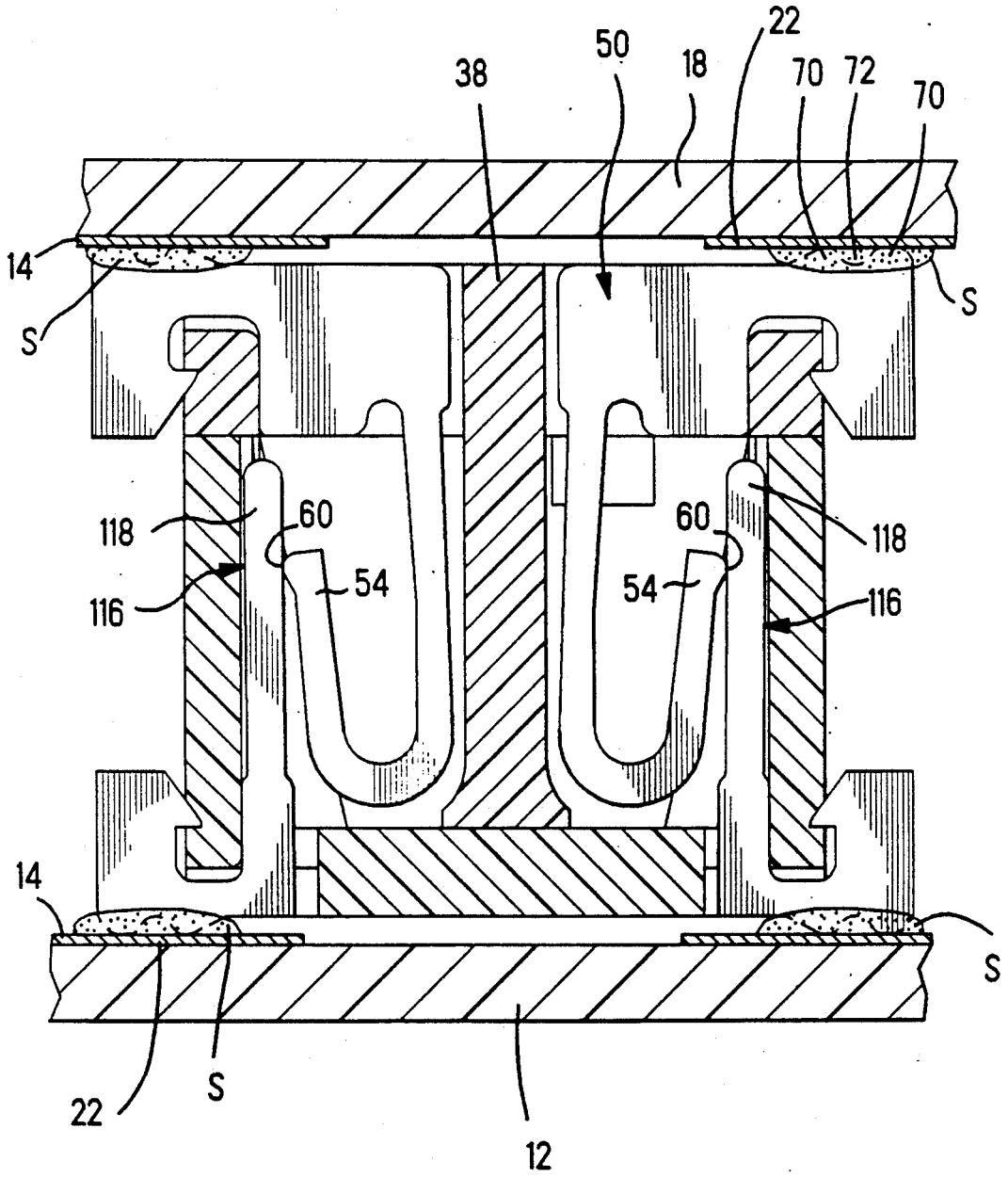
FIG. 4 is a view similar to FIG. 3 but with the connector halves intermated.
Figure 5:
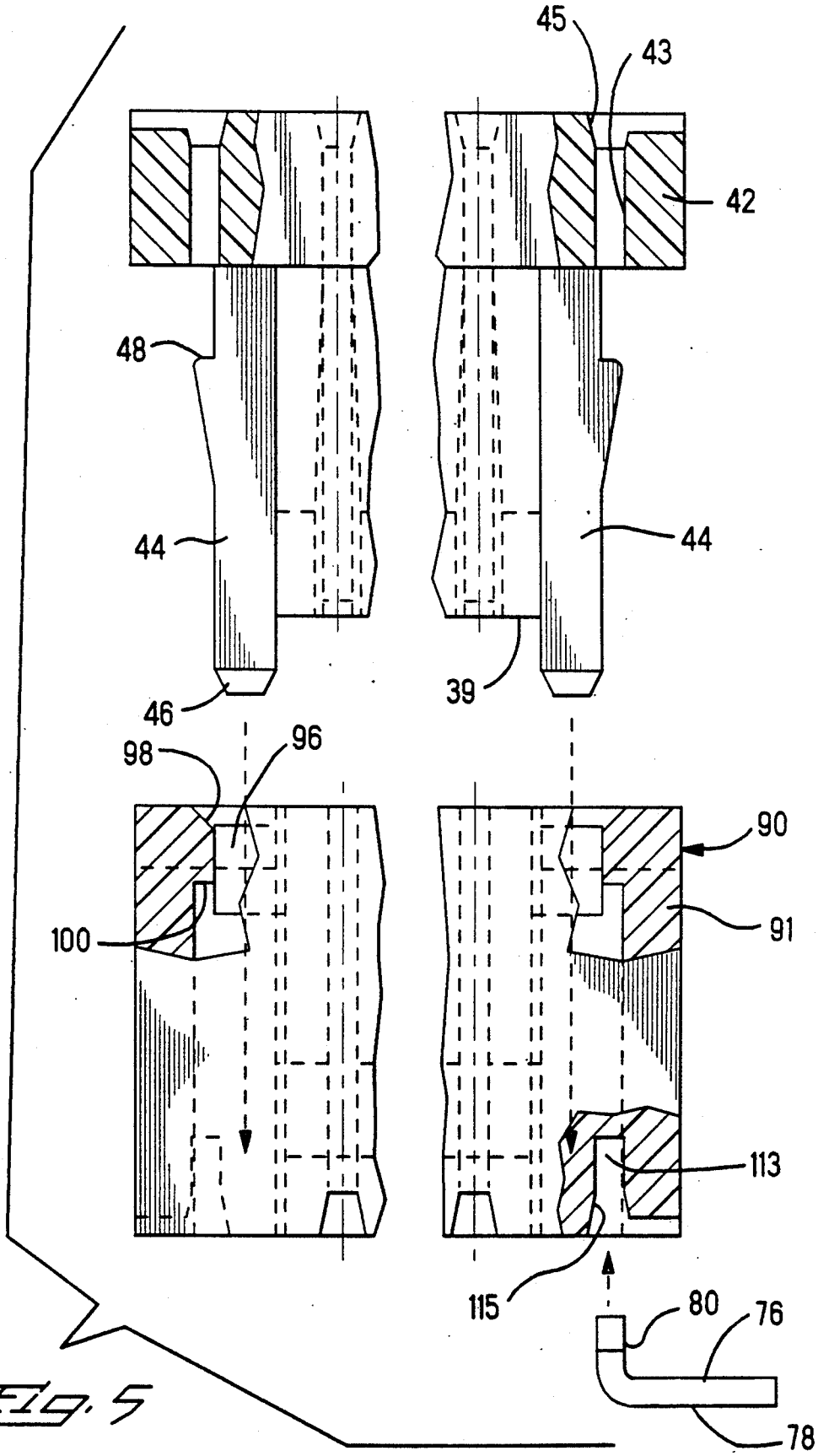
FIG. 5 is an elevation and partially sectioned view of the connector halves aligned, but prior to mating, showing the details of the alignment posts and latching surfaces.

In accordance with the invention, each of the boards 12 and 18 have respective circuit pads 14,22, as seen in FIGS. 3 and 4, which interconnect to corresponding contacts in connector halves 24,90 and circuit traces (not shown) thereon extending over the surfaces of the boards to interconnect to components or other circuits, either on the surface of the boards or within the boards, including layers within such boards. Additionally, pad-like surface traces 16 are provided on the surface of board 12 and pad-like surfaces 20 are provided on the undersurface of board 18 as shown in FIGS. 1 and 2. These conductive traces are not connected to any electrical circuit, but serve to assist in aligning the connector halves 24,90 with respect to the conductor traces on the boards and facilitate a mechanical holding of the halves by being soldered to fasteners that are part of each connector half in a manner to be described. The plug half 24 of the connector includes a plastic housing 26 that has a floor 28 and a portion 30 extending therefrom. A series of recesses 32 are provided, extending through floor 28 and up along the portion 30 to receive and accommodate contacts fitted in the housing. As can be discerned in FIG. 1, and in more detail in FIG. 3, the upper portion 30 of the housing 26 includes a bevel 34 which facilitates blind entry of the plug half 24 into the receptacle half 90. As shown in FIG. 3, the beveled portion 34 leads to an outer side wall 36. Interiorly of the recesses 32 is a dividing wall 38, shown in FIG. 3, and outside edge portions 40 of the floor 28 that include outside surfaces 42 engaged by portions of the contacts 50 to lock the contacts 50 to the housing 26 in a manner to be described. As can be seen in FIG. 1 and in more detail in FIGS. 5 and 6, the plug housing 26 includes alignment posts 44, beveled at the ends as at 46 which protrude beyond the portion 30 of the connector housing and are formed integrally with the housing when it is molded. The alignment posts 44, stationed proximate the ends of the housing 26, also include a latch 48 which is shown in detail in FIG. 5 and in engagement in FIG. 6 with surfaces 100 of the receptacle. As can be seen in FIG. 5, the posts 44 project well above the end surface 39 of the housing 26.

Each of the housing halves further includes at the ends a recess to receive a fastener, fasteners 76 shown in FIGS. 1 and 5. The recesses include, in the plug half 24 shown in FIG. 5, a passage 43 and a bevel 45 facilitating the insertion of the fastener 76. The receptacle half includes a passage 13 with a bevel 115.

Figure 8:
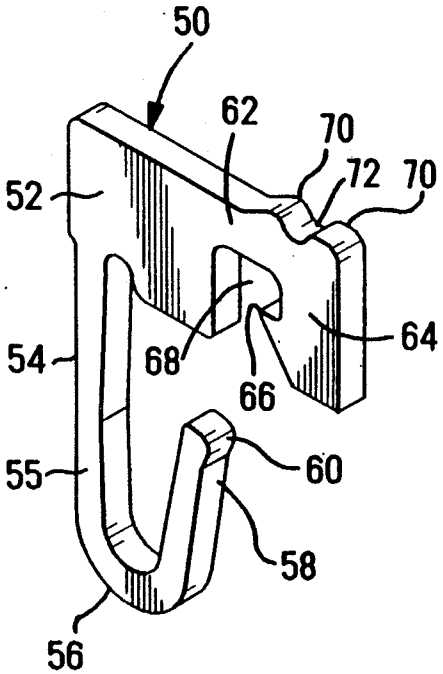
FIG. 8 is a perspective view of a contact utilized with the plug half of the connector of the invention.

Referring now to FIG. 3, the housing 26 includes two rows of contacts 50 inserted therein. As can be appreciated, these contacts, also shown in FIG. 8, are flat metal stampings having a profile defining a variety of contact characteristics. These contacts 50 are, in essence, set on edge and inserted into the housing 26 from the bottom thereof through a portion of floor 28 to extend within the recesses 32. Each of the contacts 50 has a base or foot portion 52 with an upstanding spring portion 54, a bend 56, a downwardly projecting portion 58, and a rounded end portion 60. Extending from the base portion 52 is a further portion 62 which, together with an upstanding leg 64, defines the position of a barb 66 internally directed in a relief 68 shown in FIG. 8 in the base or foot 52 of the contact 50. As can be seen in FIG. 3, when the contact 50 is loaded into the housing, the barb 66 bites into the surface 42 of the floor 28 to lock the contact to the housing. Note in FIG. 3 that the wall portion 40 limits the insertion of the contact 50 within the housing in one direction with the barb 66 limiting displacement of the contact 50 in an opposite direction. Additionally shown in FIG. 8 and in FIG. 3 are details of the foot 52 of the contact 50 which facilitate soldering to the circuit trace 22 of board 18. The contact portion 52 includes a pair of rounded points 70, which are spaced apart to define a well 72 intended to accommodate a fillet of solder upon reflowing of solder between the trace 22 and the contact 50. FIG. 4 shows the mated connector halves with solder fillets S appropriately reflowed to interconnect the contacts of the connector to the traces of the printed circuit boards 12 and 18 and the traces 14 and 22 of such boards. As can be appreciated, the points 70 defined by curved, rounded surfaces including the well 72 increase the surface area, the edge surface area of the contacts, as well as defining a body of solder extending along the surfaces to thus broaden the contact area between solder and contact. It has been discovered that wells provided at the interface of solder joints not only mechanically strengthen the interface through providing an additional volume of solder as well as an additional surface area, but improve the electrical characteristics as well. Using points such as 70 rather than flat surfaces also controls precisely the point of contact between surfaces.

To be noted in FIG. 3, the contact 50 is positioned within the housing 26 so as to be freestanding, with respect to the spring end, the J portion of the contact 50. Also to be noted is the action of the barb 66 in holding the contact 50 rigidly within the housing 26 with a clearance sufficient to permit a deflection of the contact 50 in the manner shown in FIG. 4 when engaged with the opposing contact 116 of the receptacle half 90. The invention contemplates that the contacts 50 may be formed by stamping a thin sheet metal stock such as phosphor bronze on the order of 0.008 inches in thickness of considerable hardness, such as a hardness of 10 M. The J portion of the contact in a prototype design had a height on the order of 0.111 inches as measured between the root of the spring and the top of the bend. The overall height of the contact was on the order of 0.160 inches.

As can be appreciated from the view shown in FIG. 3, the J portion of contact 50, including portions 54, 56, 58, and 60 reside in a relaxed state within the profile of the housing 26, the ends 60 extending within recess 32 proximate to the surface 36 forming the side wall of the housing 26. In this way, the relatively delicate contacts 50 are protected from damage and handling following manufacture and prior to use. Also to be noted with respect to the showings in FIGS. 3 and 4, is the fact that the base portions 52, including the points 70, well 72, and portions 64 extend out from the edge of the housings 26 to be readily visible in the manner shown in FIG. 2. This allows an inspection of the connector halves, resting upon the surface of their respective boards, prior to soldering and following soldering. Moreover, it allows the use of heat to readily get to the contacts 50 to cause a solder reflow, including particularly infrared heat, which will strike the projecting portions of the contacts to effect solder reflow. In practice, the plastic of the housings should be made of a material capable of withstanding the heat associated with solder reflow, high temperature surface mount plastics of a type having little shrinkage and bowing with easy to flow thin walls are preferred. A Eastman Kodak material Ektar-CG907-8906-C or a material Vectra-E130 from Hochst-Celanese are examples of such materials.

Figure 6:
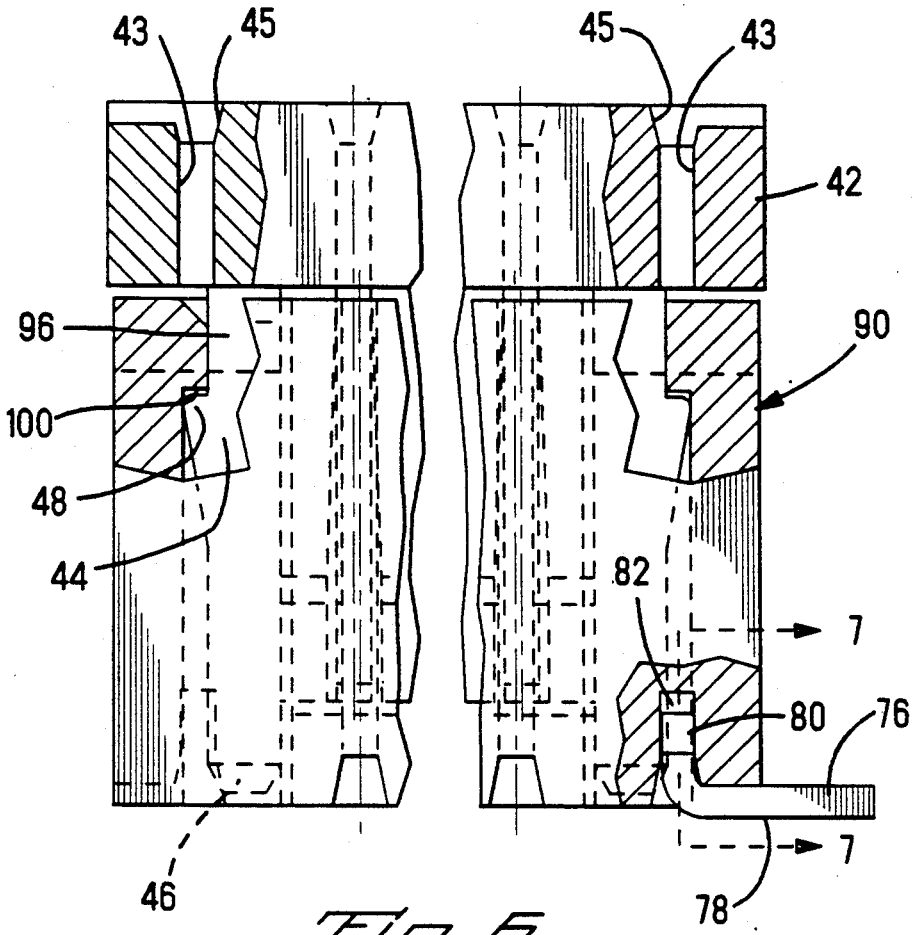
FIG. 6 is a view of the connector shown in FIG. 5 but intermated.
Figure 7:
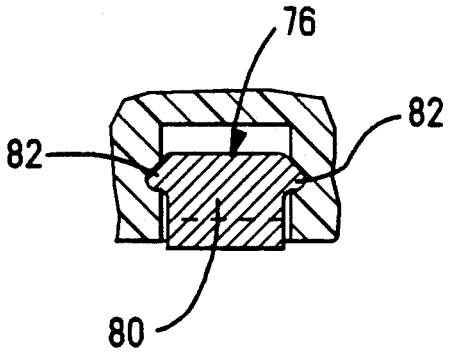
FIG. 7 is a detail of the fastener latching within the housing of a connector half taken along lines 7—7 of FIG. 6.

FIGS. 5, 6, and 7 show the application of the fasteners 76 heretofore mentioned, reference being made to the fasteners utilized with both plug and receptacle halves 24,90. In FIG. 5, a fastener 76 may be seen to include a flat pad surface 78 joining an upturned projection 80 with the fastener positioned for insertion within the passage 113 guided by bevel 115 formed in the housing 91 of the receptacle half 90. FIG. 6 shows the fastener 76 in place, and FIG. 7 shows the portion 80 of the fastener 76 includes projections or barbs 82 which bite into the material of the housing 91 to lock the fastener 76 in place in the position shown in FIG. 6 and also in FIGS. 1 and 2. The fasteners 76 can be visually aligned with appropriate traces 16,20 on the boards 12 and 18 prior to solder to help position the halves 24,90 properly on the board surfaces. An appropriate solder paste or other means of providing solder between the pads 76 and appropriate traces on the boards may be provided to result in a solder reflow with the pads mechanically joining and fixing the connector halves to the boards.

FIGS. 5 and 6 also show the operation of the aligning and polarizing post 44, FIG. 5 showing the halves 24,90 prior to insertion and mating, and FIG. 6 showing the halves 24,90 following mating. As can be discerned, the surface latches 48 enter recesses 96 in the receptacle half 90 and engage interior surfaces 100 in such housings to hold the halves 24,90 intermated together and preclude an accidental withdrawal. The dimensions of the surfaces on latch 48 and the surfaces 100, relative to the elasticity of the plastic of the housings, is made so that the housings can be, in essence, peeled or pulled apart by drawing the two boards 12 and 18 relatively apart. To be noted in FIGS. 5 and 6 are the bevels 46 provided on posts 44 and the bevels 98 provided on recesses 96 which facilitate the blind intermating of the connector halves.

Figure 9:
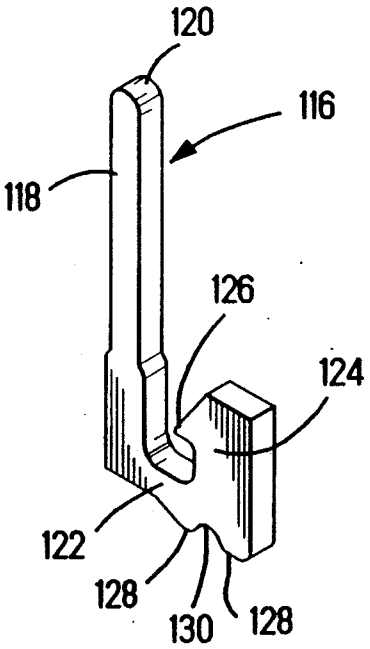
FIG. 9 is a perspective view of a contact utilized with the receptacle half of the invention.

Referring now to FIG. 1, the receptacle half 90 includes housing 91 having an interior cavity 92 which is dimensioned to receive in an easy sliding fit, the portion 30 of housing 26 from plug half 24, the beveled portions 34 thereof, easing the insertion of the plug half 24 within the receptacle half 90 in terms of alignment. The receptacle half 90 further includes ports 94 in the end side walls, which allow flow of air during mating and unmating to prevent air pressure from restricting manipulation of the housing halves 24,90. Receptacle half 90 includes a housing 91 of plastic material similar to that of the plug half 24. The housing 91 includes interiorly a series of recesses 102, as shown in FIG. 1. FIG. 3 shows the interior of housing 91 includes a series of apertures 104 allowing admission of the contacts 116 and further includes a floor 106 and exterior walls 108. To be noted is the interior surface of such walls, shown as 110, which is spaced from the contacts 116 to facilitate slight deflection of the post portion of the contacts for purposes to be described hereinafter. To be noted is the surface 112 on the exterior of the housing 91 which is engaged by a barb 126 of contact 116 to lock the contact 116 to the housing 91 in the manner described with respect to the plug half 24. FIG. 9 shows the contact 116, which is formed of a material similar to that of the contact 50, heretofore described, to include a post portion 118 rounded at 120, including a base or foot 122 having an upwardly projecting portion 124 ending in barb 126. The contact 116 includes points 128 defining a solder well 130 similar to that heretofore described with respect to the contacts 50.

As can be seen in FIG. 1, the post portions 118 of contacts 116 extend into cavity 92 exteriorly of the recesses 102 and are positioned to enter the recesses 32 in plug half housing 26 and engage the contacts 50 therein, the contact surfaces 60 engaging the edge surfaces of the post portions 118 in the manner shown in FIG. 4. This required entry of the post portions 118 into the recesses 32 of the plug half housing 26 further assures an appropriate alignment. To be noted is the fact that the surfaces of portion 118 are smooth to be engaged in a sliding movement with the surfaces 60 limiting the force of engagement as the contacts 50,116 are intermated together. Also to be noted is the fact that the surfaces 60 achieve a substantial smooth wipe along the edge and length of post portions 118. At the time the contacts 50,116 are intermated, the contacts 50,116 will have been soldered to their respective boards 18,12 to preclude movement of the contacts 50,116 which would reduce the deflection and normal force there between. This normal force is desirable to include a force sufficient to maintain a low, stable, electrical resistance between the contacts 50,116.

Figure 10:
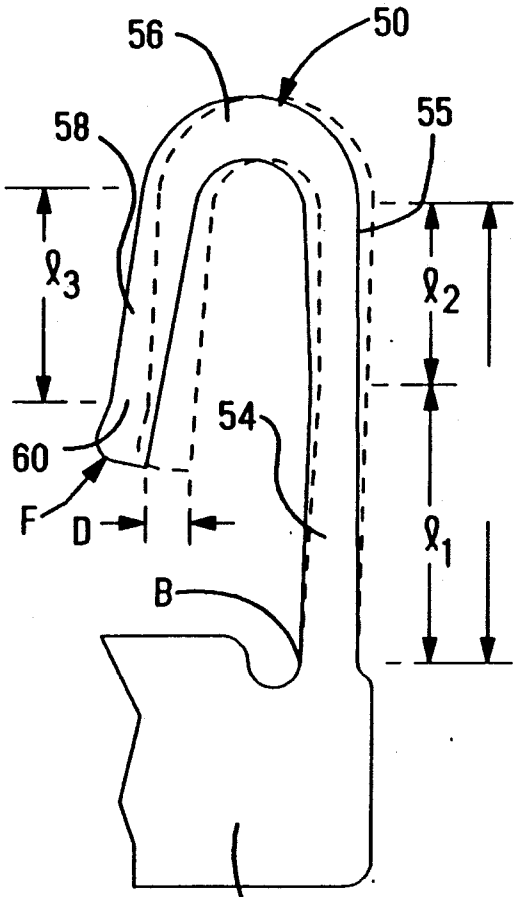
FIG. 10 is a perspective view of the contact of FIG. 9 showing a further aspect of the invention related to stress reduction.

As an additional aspect of the invention, we have discovered that by providing a tapering of the beam of contact 50 changes in normal force can be achieved as well as reductions in maximum stress in the elastic region and stress induced failure and set. In FIG. 10 the contact 50 is shown with the various leg portions 54, 55 and 58 given length dimensions $l_1$, $l_2$ and $l_3$ with each of the leg portions tapered. The leg portion 54 tapers inwardly, from the base B to a point joining leg portion 55 that tapers outwardly to a point where the leg portion 55 joins bend 56. The leg portion 58 tapers inwardly, from the bend 56 to just proximate the enlarged end defining contact surface 60. By virtue of the tapers stress in the contact induced by deflection D developed by a force F due to mating engagement with contact 116 is distributed along the beams reducing the maximum stress in bend 56 and at the base B as compared to a non-tapered beam. The taper of leg portion 58 similarly distributes the stress along that beam reducing the maximum stress in the bend B.

The following is an example of the use of a tapered beam width to achieve the design goal to maintain sufficient normal force, which assures the electrical integrity of the interface, while reducing maximum elastic stress limits for a defined deflection. In a contact 50 of constant beam width on the order of 0.011 inches in a 10 M hard phosphor bronze material 0.008 inches thick and an overall height L of 0.160 inches, the maximum elastic equivalent stress was 223,900 p.s.i. occurring proximate base B for a maximum deflection of 0.008 inches. A contact of the same material and thickness with the same deflection having a taper from 0.011 inches to 0.009 inches for $1_1$ and from 0.009 inches to 0.0124 inches for $1_2$ and $1_3$ reduced the maximum elastic stress to 183,500 p.s.i.; $1_1$ being 0.00546 inches, $1_2$ being 0.0354 inches and $1_3$ being 0.030 inches in length. This demonstrates a 22% reduction in the maximum stress while the normal force was maintained ar a reasonably high level. The non-tapered contact developed a normal force F of 0.441 pounds and the rapiered version developed a normal force F of 0.445 pounds for a maximum deflection of 0.008 inches. Additionally, in the constant width example, for a deflection of 0.0055 inches, the normal force F developed was on the order of 0.302 pounds and the normal force for the tapered version was 0.306 pounds. The maximum stress for the non-tapered beam is 153,959 p.s.i. and for the tapered version is 126,171 p.s.i. at the given nominal deflection.

By altering the lengths of tapers, stress can be distributed and maximum stress reduced. By providing tapers, the normal force of contact can be altered, raised or lowered, thus better controlling this vital parameter of contact performance.

While the foregoing examples are tied to a control of width through tapers, the invention fully recognizes that variation of cross-sectional area along the beam length by adjusting width or thickness dimensions can achieve a similar result although width control best lends itself to traditional stamping and forming processes used for contacts such as 50 and 116.

In summary, the various features of the contacts 50,116, including the alignment posts 44 and the various beveling relative to the ends of the alignment posts 44 and the housing recesses 96, the bevel 34, the locking by the respective barbs of the contacts to the housing, and the soldering of the contacts to the boards, all achieve a positioning of the connector halves 24,90 and contacts 50,116 to facilitate ready blind mating of the contact halves 24,90 to interconnect the circuits of the boards. The increased area and provision of wells at the solder joints facilitates a good, low resistance solder connection between contacts and circuits, and the provision of fasteners which are soldered to the board further stabilizes the mechanical holding of the connector halves to the boards. The contacts 50 include a tapering to reduce stress and allow optimization of force and or deflection for given beam lengths and a method for making electrical contacts.

Having now described the invention in relation to drawings of various embodiments, claims are appended, intended to define what is inventive.

We claim:

1. A miniature electrical connector for interconnecting circuits on close centers on the surfaces of circuit boards including plug and receptacle housings each having arrays of contacts of thin sheet metal set on edge in such housings on centers complementary to the centers of the circuits and including contact feet projecting from said housings in a common plane for soldering to said circuits with the receptacle housing including an interior cavity configured to receive the plug housing inserted therein along a given axis and with the plug housing having a bevel to ease entry into said cavity and having interior recesses containing said plug contacts therewithin positioned to receive said receptacle contacts entering said recesses to engage said plug contacts in a sliding engagement, where said contact feet include a U-shaped configuration with a locking point interiorly of the U-shaped configuration adapted to bite into the housing to hold the contact relative to the housing, and said plug and receptacle contacts each have ends opposite said feet positioned to be deflected transversely to said axis during such engagement to develop low resistance, stable electrical interfaces, said plug housing including a plurality of posts projecting from a front face thereof and the receptacle housing including interior recesses positioned to receive said posts to polarize and align said housings to assure entry of the receptacle contacts into the recesses of the plug housing and facilitate blind mating of said housings.

2. The connector of claim 1 wherein said contact feet include a plurality of contact points spaced apart to engage a board at two points and to define a well therebetween increasing the contact surface area and volume of solder between the contact and the circuits of the board.

3. The connector of claim 1 wherein said contact feet extend outwardly from the sides of the said housing to facilitate inspection of the positioning of a housing relative to the circuits of a circuit board and the application of heat to effect solder reflow with the resulting solder joints being visually observable.

4. The connector of claim 1 wherein the contacts of the plug include a J profile having a contact surface on the end thereof.

5. The connector of claim 1 wherein said posts and recesses include latching surfaces to latch the housings together upon the plug half housing being fitted into the receptacle housing.

6. A miniature electrical connector for interconnecting circuits on close centers on the surfaces of circuit boards including plug and receptacle housings each having arrays of contacts of thin sheet metal set on edge in such housings on centers complementary to the centers of the circuits and including contact feet projecting from said housings in a common plane for soldering to said circuits with the receptacle housing including an interior cavity configured to receive the plug housing inserted therein along a given axis and with the plug housing having a bevel to ease entry into said cavity and having interior recesses containing said plug contacts therewithin positioned to receive said receptacle contacts entering said recesses to engage said plug contacts in a sliding engagement, where the housings of the plug and receptacle each include metallic fasteners extending from the surfaces thereof and positioned to engage a circuit surface and be soldered thereto to hold said housings to the respective circuit boards, and said plug and receptacle contacts each have ends opposite said feet positioned to be deflected transversely to said axis during such engagement to develop low resistance, stable electrical interfaces, said plug housing including a plurality of posts projecting from a front face thereof and the receptacle housing including interior recesses positioned to receive said posts to polarize and align said housings to assure entry of the receptacle contacts into the recesses of the plug housing and facilitate blind mating of said housings.

7. The connector of claim 6 wherein the said fasteners include flat surfaces to effect a solder connection to the flat surfaces of metallic pads of a board surface.

8. The connector of claim 7 wherein each of said fasteners includes a projection having a latch thereon fitting into a housing to hold a said fastener to the housing.

* * * * *